US005183320A

United States Patent [19]

Chen

[11] Patent Number: 5,183,320

[45] Date of Patent: Feb. 2, 1993

[54] ANTI-DESTRUCTION STRUCTURE FOR AN AUTOMATIC VENDING MACHINE

[76] Inventor: Ming-Ho Chen, No. 166, Fu-Hsing Rd., Hsin-Ying City, Tainan Hsien, Taiwan

[21] Appl. No.: 779,934

[22] Filed: Oct. 21, 1991

[51] Int. Cl.[5] ..... A47B 96/00

[52] U.S. Cl. ..... 312/229; 312/213

[58] Field of Search ..... 193/32; 198/534; 312/229, 60, 213

[56] References Cited

U.S. PATENT DOCUMENTS 799,067 1/1905 Briggs ..... 193/32

1,494,696 5/1924 Maclaren ..... 192/32

3,417,881 12/1988 Loveless ..... 193/32 X 4,085,987 4/1978 Vartdal ..... 312/229 X

*Primary Examiner*—Peter R. Brown

*Attorney, Agent, or Firm*—Baker & Daniels

[57] ABSTRACT

An anti-destruction structure for an automatic vending machine includes a plurality of holes formed through a bottom plate mounted securely on the lower end portion of a housing, and a porous auxiliary plate fixed in the housing just above the bottom plate. The auxiliary plate has a plurality of holes formed therethrough. The holes of the auxiliary plate are communicated with and staggered relative to the holes of the bottom plate.

6 Claims, 6 Drawing Sheets

ANTI-DESTRUCTION STRUCTURE FOR AN AUTOMATIC VENDING MACHINE

BACKGROUND OF THE INVENTION

1. Field of the Invention

This invention relates to an automatic vending machine, more particularly to an anti-destruction structure for an automatic vending machine.

2. Description of the Related Art

The improvement of this invention is directed to a portion of an automatic vending machine, which is shown in FIG. 1. As illustrated, the automatic vending machine includes a housing 1, a vertical support frame 11 fixed on the middle portion of the housing 1, and a bottom plate 12 mounted securely on the bottom end of the support frame 11. Two L-cross-sectioned side plates 12 are connected securely to two opposite sides of the support frame 11. The support frame 11 has six rectangular upper grooves 111 for mounting pushbuttons therein, a rectangular intermediate groove 112 forming a coin slot, and a rectangular lower groove 113 accommodating a merchandise discharge casing 3 therein. The casing 3 includes a merchandise accommodating space 31 and a shield plate 32 and is shaped so that the merchandise to be sold can be guided to the accommodating space 31 under the shield 32, thereby permitting the merchandise to be accessed through the lower groove 113. A destroyer may pour petroleum or hydrochloric acid into the housing 1 so as to burn or corrode the machine. Referring to FIG. 2, because the housing 1 has a bottom plate 12 and the casing 3 has a bottom wall, when being poured into the housing 1, petroleum or hydrochloric acid is entirely confined in the casing 3 or on the bottom plate 12, thereby causing a great deal of damage to the machine.

SUMMARY OF THE INVENTION

It is therefore the main object of this invention to provide an automatic vending machine with an anti-destruction structure which minimizes damage to the machine when vandalized.

According to this invention, an anti-destruction structure for an automatic vending machine includes a plurality of holes formed through a bottom plate mounted securely on the lower end portion of a housing, and a porous auxiliary plate fixed in the housing just above the bottom plate. The auxiliary plate has a plurality of holes formed therethrough. The holes of the auxiliary plate are communicated with and staggered relative to the holes of the bottom plate. Accordingly, a destroyer cannot insert an elongated tool into the machine through the holes of the bottom plate and the casing for destructive purposes.

In one embodiment, a merchandise discharge casing is provided in the machine just above the bottom plate and has a porous bottom wall with a plurality of holes. The holes of the bottom wall of the casing are communicated with and staggered relative to the holes of the bottom plate. The casing further includes a horizontal swing plate made of a fireproof material, and a pivot mounting rotatably the swing plate in the upper portion of the casing. The swing plate has a merchandise accepting portion on one side of the pivot, and a balancing portion on the other side of the pivot. The merchandise accepting portion is positioned so that the merchandise to be sold can fall thereon, thereby decelerating the merchandise. A counterweight is carried on the balancing portion of the swing plate so as to maintain the swing plate in a horizontal position when the machine is in a normal condition. Because the swing plate is provided in the upper portion of the casing, the flame created from the petroleum left on the bottom wall of the casing is prevented from extending upward from the casing.

BRIEF DESCRIPTION OF THE DRAWINGS

Other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
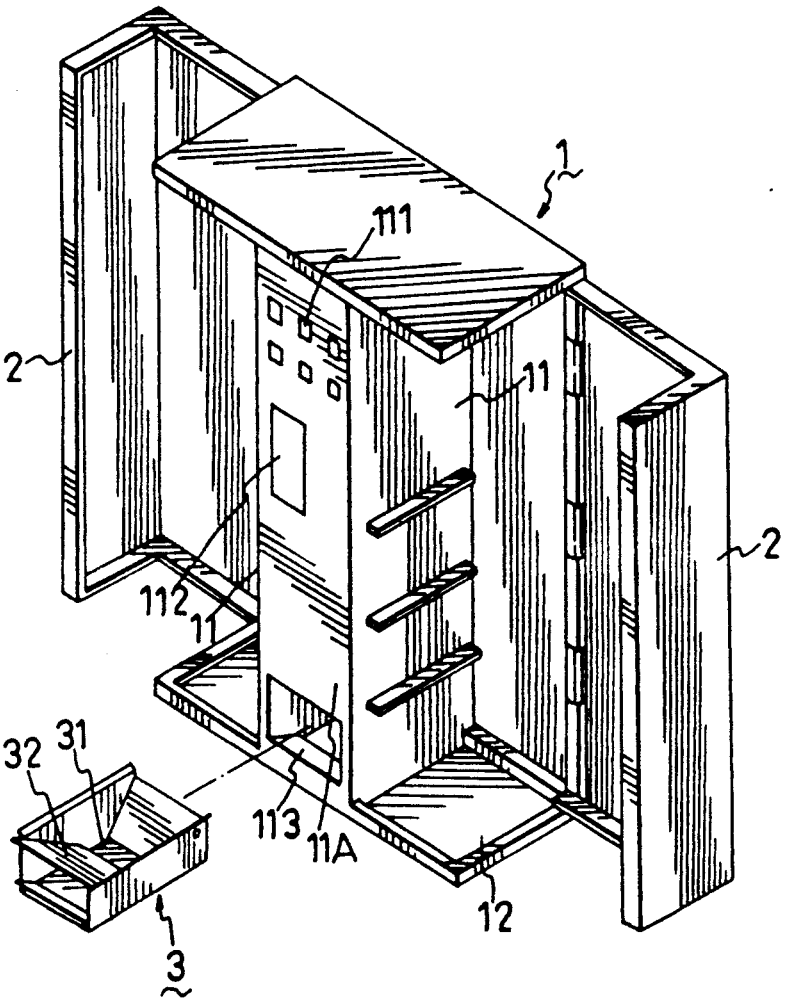
FIG.1 PRIOR ART
FIG. 1 is a perspective view showing a portion of a conventional automatic vending machine.
Figure 2:
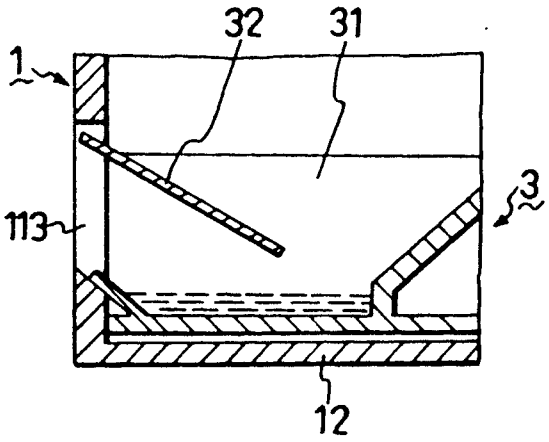
FIG. 2 PRIOR ART
FIG. 2 is a sectional view showing the bottom plate of a housing and the bottom wall of a merchandise discharge casing of the conventional automatic vending machine.
Figure 3:
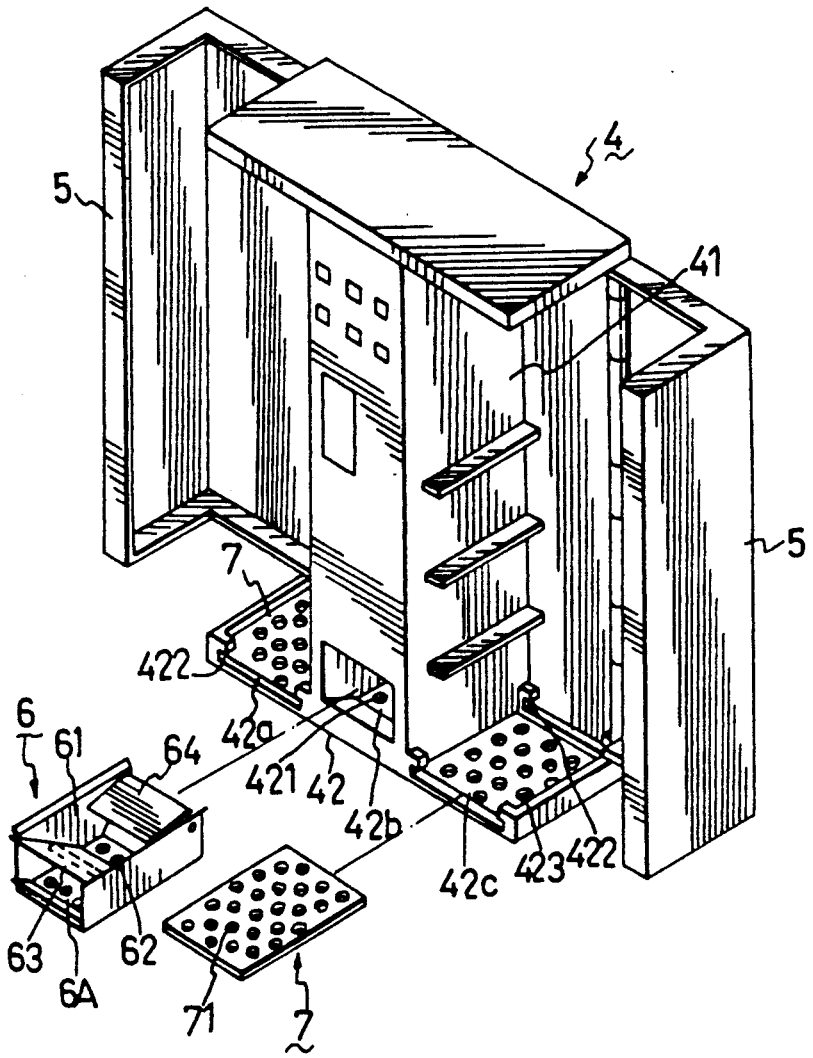
FIG. 3 is a perspective view of an anti-destruction structure for an automatic vending machine according to a first embodiment of this invention.
Figure 4:
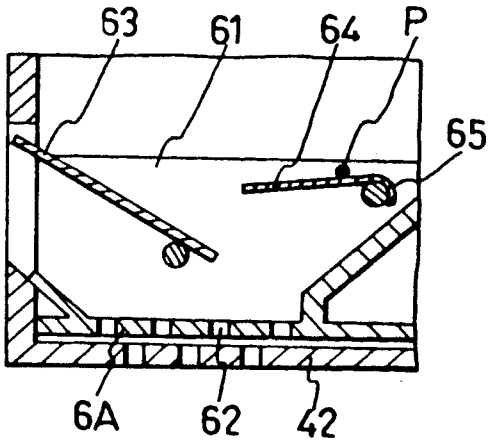
FIG. 4 is a sectional view showing a merchandise discharge casing and the bottom plate of a housing of the anti-destruction structure according to the first embodiment of this invention.
Figure 6:
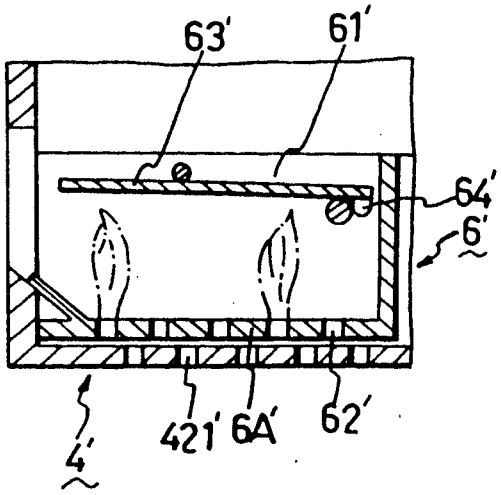
FIG. 6 is a sectional view showing a merchandise discharge casing and the bottom plate of a housing of the anti-destruction structure for an automatic vending machine according to a second embodiment of this invention.

Referring to FIGS. 3 and 4, an anti-destruction structure of this invention is used for an automatic vending machine in which a housing 4 and two L-cross-sectioned cover plates 5 are provided in a known manner. The housing 4 is provided with a vertical support frame 41. A merchandise discharge casing 6 is received in the rectangular lower groove of the support frame 41.

Figure 5:
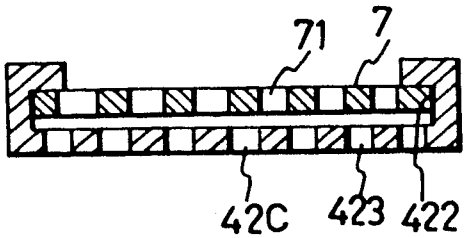
FIG. 5 is a sectional view showing an auxiliary plate and the bottom plate of the anti-destruction structure according to the first embodiment of this invention.

The housing 4 further includes a bottom plate 42 connected securely to the bottom end of the support frame 41, which has a porous left side portion **42*a*, a porous middle portion 42*b* and a porous right side portion 42*c*. The middle portion 42*b* of the bottom plate 42 is positioned under the support frame 41 and has a plurality of holes 421 which are communicated with the lower groove of the support frame 41. The casing 6 has a merchandise accommodating space 61 and a porous bottom wall 6A with a plurality of holes 62. As best shown in FIG. 4, since the holes 62 of the casing 6 are communicated with and staggered relative to the holes 421 of the bottom plate 42, a destroyer cannot insert an elongated tool into the machine through the holes 421 of the middle portion 42*b* of the bottom plate 42 and the holes 62 of the casing 6 for destructive purposes. Furthermore, when a harmful destroying liquid, such as petroleum or hydrochloric acid, is poured into the casing 6, the majority of the liquid flows out of the housing 4 through the holes 421 and the holes 62 so as to prevent the destroying liquid from causing significant damage to the interior of the machine. Accordingly, only a very small amount of the destroying liquid remains on the porous bottom wall 6A and the porous bottom plate 7. Each of the side portions 42***a*, 42*c* of the bottom plate 42 has two slide slots 422 in the front and rear ends thereof. Two porous auxiliary plates 7 (only one is shown for clarity) are inserted into the slide slots 422 and positioned just above the porous side portions 42*a*, 42*c* of the bottom plate 42. As best shown in FIG. 5, the holes 71 of the auxiliary plates 7 are communicated with and staggered relative to the holes 423 of the corresponding side portions 42*a*, 42*c* of the bottom plate 42, so as to achieve the same effect as the holes 62 of the casing 6.

As best shown in FIG. 4, the casing 6 includes an inclined slide plate 63 fixed in the front portion thereof, and a horizontal swing plate 64 mounted pivotally in the rear portion of the casing 6 by a pivot (P). The swing plate 64 is made of a fireproof material and has a merchandise accepting portion on the front side of the pivot (P), and a balancing portion on the rear side of the pivot (P). The merchandise accepting portion is positioned so that the merchandise to be sold can fall thereon, thereby decelerating the speed of the falling merchandise. A counterweight 65 is carried on the rear end of the swing plate 64 so as to maintain the swing plate 64 in a horizontal position when the machine is in a normal position. With the slide plate 63 and the swing plate 64 provided in the upper portion of the casing 6, the flame created from the very small amount of the petroleum left on the bottom wall 6A of the casing 6 is prevented from extending upward from the casing 6.

FIG. 5 illustrates a structure which is a modification of FIG. 4. As illustrated, the casing 6' has a merchandise accommodating space 61' and a porous bottom wall 6A' with a plurality of holes 62' which are also communicated with and staggered relative to the holes 421' of the bottom plate of the housing 4'. Unlike the previous embodiment, this embodiment excludes the slide plate 63 and includes a longer swing plate 63'.

Figure 7:
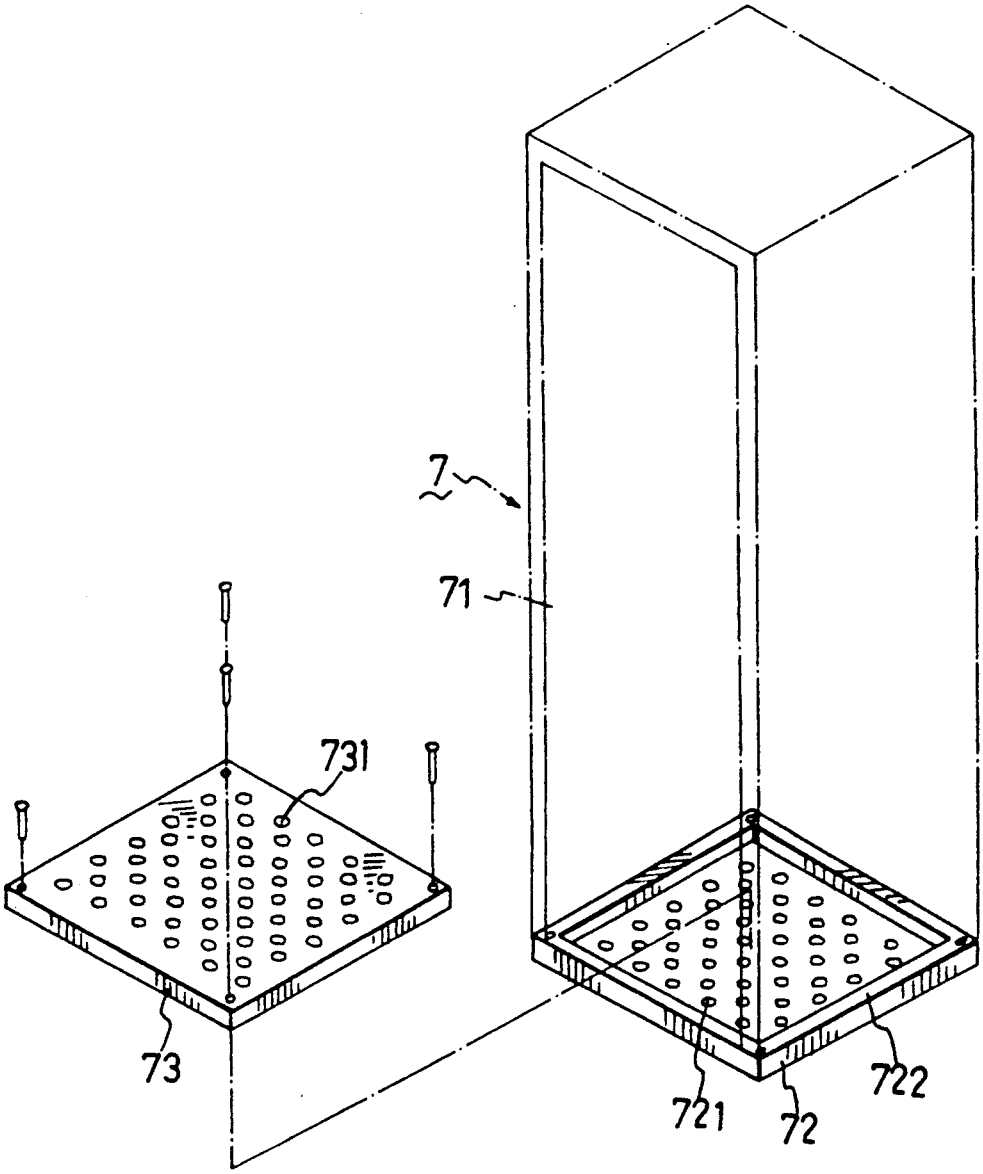
FIG. 7 is a schematic view illustrating an anti-destruction structure for an automatic vending machine according to a third embodiment of this invention.

FIG. 7 illustrates an application of this invention to a reduced-volume automatic vending machine. As illustrated, the housing 7 of the machine has a cover plate 71 and a porous bottom plate 72 having a plurality of holes 722 and surrounded by a rectangular frame 722. A porous auxiliary plate 73 is screwed to the frame 722 just above the bottom plate 72. The holes 722 are communicated with and staggered relative to the holes 731 of the auxiliary plate 73.

With this invention thus explained, it is apparent that numerous modifications and variations can be made without departing from the scope and spirit of this invention. It is therefore intended that this invention be limited only as indicated in the appended claims.

I claim:

1. An anti-destruction structure for an automatic vending machine, the automatic vending machine including a housing having a lower end portion, the anti-destruction structure comprising:

a bottom plate disposed at said lower end portion, said bottom plate having a plurality of holes formed therethrough; and a porous auxiliary plate fixed in said housing just above said bottom plate, said auxiliary plate having a plurality of holes formed therethrough, said holes of said auxiliary plate being communicated with and staggered relative to said holes of a corresponding portion of said bottom plate.

2. An anti-destruction structure as claimed in claim 1, further comprising a merchandise casing provided in said lower end portion of said machine just above said bottom plate, said merchandise casing including a porous bottom wall having a plurality of holes formed therethrough, said holes of said bottom wall of said casing being communicated with and staggered relative to said holes of a corresponding portion of said bottom plate.

3. An anti-destruction structure as claimed in claim 2, wherein said merchandise casing includes:

a horizontal swing plate made of a fireproof material; and a pivot rotatably mounting said swing plate in an upper portion of said casing;

said swing plate having a merchandise accepting portion on one side of said pivot, and a balancing portion on another side of said pivot, said merchandise accepting portion being positioned so that merchandise to be sold can fall thereon, thereby decelerating falling speed of said merchandise, said balancing portion of said swing plate being provided with a counterweight so as to maintain said swing plate in a horizontal position when said machine is in a normal condition.

4. In an automatic vending machine having a housing with a lower end portion, an anti-destruction structure comprising:

a bottom plate disposed in the lower end portion, said bottom plate having a plurality of holes formed therethrough; and a porous auxiliary plate fixedly disposed in the lower end portion above said bottom plate, said porous auxiliary plate having a plurality of holes formed therethrough, said porous auxiliary plate being aligned relative to said bottom plate such that said plurality of holes of said porous auxiliary plate are in staggered communication with said plurality of holes of said bottom plate.

5. In an automatic vending machine for vending merchandise, the automatic vending machine having a housing with a lower end portion, an anti-destruction structure comprising:

a bottom plate disposed in the lower end portion, said bottom plate having a plurality of holes formed therethrough; and a merchandise discharge casing disposed in said lower end portion above said bottom plate, said merchandise discharge casing including a porous bottom wall having a plurality of holes formed therethrough, said porous bottom wall being aligned relative to said bottom plate such that said plurality of holes of said porous bottom wall are in staggered communication with said plurality of holes of said bottom plate.

6. The anti-destruction structure of claim 5, wherein said merchandise discharge casing includes a horizontal swing plate pivotally mounted in said merchandise discharge casing and made of a fireproof material, said merchandise discharge casing having a merchandise accepting portion on a side of said horizontal swing plate and a balancing portion on another side of said horizontal swing plate, said merchandise accepting portion being positioned so that sold merchandise can fall thereon thereby decelerating the falling speed of the merchandise, said balancing portion provided with a counterweight so as to maintain said horizontal swing plate in a horizontal position when the machine is in a normal condition.

* * * * *